United States Patent [19]

Nagasaki et al.

[11] 4,160,662

[45] Jul. 10, 1979

[54] METHOD FOR THE REMOVAL OF SCUM

[75] Inventors: Katsumi Nagasaki, Sakai; Yoshihiro Inoue, Nishinomiya; Hiroyuki Yamazaki, Amagasaki; Akifumi Yano, Osaka; Tetsuo Momose, Hirakata, all of Japan

[73] Assignee: Kubota, Ltd., Osaka, Japan

[21] Appl. No.: 804,530

[22] Filed: Jun. 8, 1977

[30] Foreign Application Priority Data

Jun. 11, 1976 [JP] Japan ..... 51/69234

[51] Int. Cl.[2] ..... C21B 3/04

[52] U.S. Cl. ..... 75/24; 75/61; 266/44; 266/227

[58] Field of Search ..... 75/24, 49, 61; 266/201, 266/44, 227; 15/345, 346; 219/74, 75; 228/20

[56] References Cited

U.S. PATENT DOCUMENTS

| | | | |
|---|---|---|---|
| 3,200,233 | 8/1965 | Anderson | 219/74 |
| 3,517,727 | 6/1970 | Babel | 75/10 R |
| 3,867,132 | 2/1975 | Perry | 75/24 |
| 3,923,499 | 12/1975 | Manthey et al. | 75/24 |
| 3,979,108 | 9/1976 | Nagasaki | 75/24 |

*Primary Examiner*—M. J. Andrews
*Attorney, Agent, or Firm*—Joseph W. Farley

[57] ABSTRACT

A method of removing slag or like scum from the surface of molten metal by suction. A tubular gaseous stream directed toward the surface of scum is formed, with its interior space communicating with a suction source such as an ejector or vacuum pump. The gaseous stream hampers the inflow of external air into the suction zone surrounded by the stream. On reaching the scum surface, the gaseous stream flows inward along the scum surface and is thereafter drawn toward the suction source, so that the stream acts to blow the scum radially inwardly of the stream and thereafter raises the scum from the surface of molten metal, thus permitting efficient removal of the scum with a relatively low suction. A scum removing apparatus for practicing this method includes a suction source, a suction head communicating with the suction source, and annular nozzle means provided around the suction head for forming a tubular gaseous stream flowing toward the surface of scum.

10 Claims, 5 Drawing Figures

METHOD FOR THE REMOVAL OF SCUM

This invention relates to a method of and an apparatus for removing scum such as slag on the surface of molten metal or other floating solids by suction.

The term "scum" used herein includes slag in ladles for blast furnaces, slag in Heroult electric furnaces, slag in ladles used in making steel, slag in low-frequency induction furnaces and reverberatory furnaces, slag in ladles for cupolas, slag produced in making rimmed steel, and slag produced in melting metals and various other materials and floating on the molten materials.

Although various scum removing methods have been practiced, they are inefficient and involve problems as stated in U.S. Pat. No. 3,979,108. To overcome the problems, suction methods have been proposed as efficient methods. They include an ejector method which employs a suction head having an inlet positioned above the scum to be sucked and an ejector serving as a suction source in communication with the suction head and operable with the compressed air supplied from a compressor. As disclosed in the specification of the above-mentioned patent, however, the ejector method is not feasible because of the low suction capacity of the ejector. Especially, the method is not usable in the case where water is sprayed to the sucked scum to solidify the scum to pellets by rapid cooling.

To eliminate the drawback of the ejector method, the patent specification discloses a system as shown in FIG. 1 and comprising a suction head 4 opposed to and positioned a suitable distance above scum 3 on the surface of molten metal 2 in a ladle 1, suction means 5 such as a vacuum pump or rotary blower serving as a suction source in communication with the suction head 4, and a scum separator 6 provided between the suction head 4 and the suction means 5. According to this system, the scum is sucked from the inlet of the suction head 4, and the water supplied from a duct 7 is forced against the sucked scum to solidify or preferably pelletize the scum by cooling. The sucked air stream containing a mixture of the solid scum, water and water vapor derived from the water is then fed to the scum separator 6, in which the scum and water are separated from the air stream and run off from the air passage. The air stream separated from the scum and water is sucked by the suction means 5 and released to the atmosphere. The use of the above system renders the suction method feasible for the removal of scum, but the system still remains to be improved in that it requires suction means of great capacity which is expensive.

Seemingly, suction means of reduced capacity would be serviceable, if the distance between the scum surface and the open end of the suction channel, i.e. the inlet of the suction head, is reduced, because the pipes and various means connected to suction means are as a rule closed. However, to ensure safety in the system which involves the application of water in the vicinity of the suction inlet, it is required that the distance should rather be greater. Accordingly, the suction head 4 must be positioned a suitable distance h above the surface of the scum 3 as shown in FIG. 2, with the inevitable result that the sucking of the scum 3 entails the formation of an air stream as indicated by the arrows, drawing an increased amount of air not contributing to the sucking of the scum 3. With attention given to the fact that the suction on the scum generally relates to the velocity of air flow on the scum surface, it appears possible to greatly improve the scum sucking efficiency by minimizing the amount of external air drawn in and increasing the velocity of air flow on the scum surface without reducing the distance h. It would then be possible to suck the scum even with the use of suction means of relatively small capacity while maintaining the required distance h, thus rendering the ejector method feasible under favorable conditions.

The main object of this invention is to overcome the foregoing problem by specified means and to thereby provide a method of removing scum by suction with high efficiency and therefore with suction means of reduced capacity.

To fulfill this object, the present invention provides a scum removing method in which a tubular gaseous stream directed to the surface of scum is formed, with negative pressure applied to the interior space of the gaseous stream.

Another object of this invention is to reduce the amount of the gaseous medium for forming the gaseous stream and to thereby achieve a saving in the amount of gaseous medium and reduce the suction capacity for sucking the gaseous medium.

To this end, the gaseous stream is preheated in the preferred mode of practicing this invention. Further when desired, steam is used as the gaseous medium. In such case, the gaseous stream contracts when sucked and cooled, thus permitting the use of a suction source of correspondingly reduced capacity. The use of preheated gaseous stream eliminates the objection that the scum would otherwise become less flowable and less amenable to the suction by being cooled on contact with a cold gaseous stream. Apparently, the greater the flow velocity of the stream, the more effectively will the stream act to assist in the sucking action. Flow velocities of up to about 1 Mach are practically useful.

Another object of this invention is to provide an apparatus for practicing the above method for the removal of scum. To achieve this object, this invention provides a scum removing apparatus having a suction source and a suction head communicating with the suction source, the apparatus comprising means for forming a tubular gaseous stream flowing from the outer periphery of the suction head toward the surface of scum, and annular nozzle means provided at least around the suction head.

According to the preferred embodiment of this invention, the suction head is provided therearound with a preheating chamber in communication with the annular nozzle means.

Various other features and advantages of this invention will be readily understood from the following description of the preferred embodiment of the invention given with reference to the accompanying drawings, in which.

Figure 1:
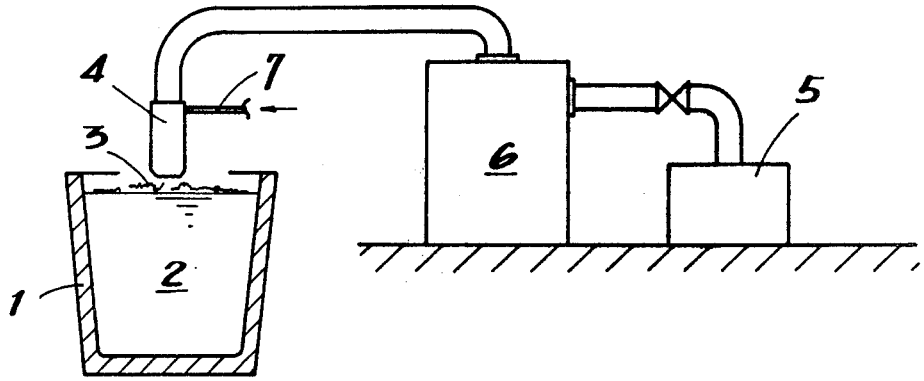
FIG. 1 is a schematic view illustrating a system including suction means such as a vacuum pump or an ejector serving as a suction source as it is operated for the removal of scum by suction.
Figure 2:
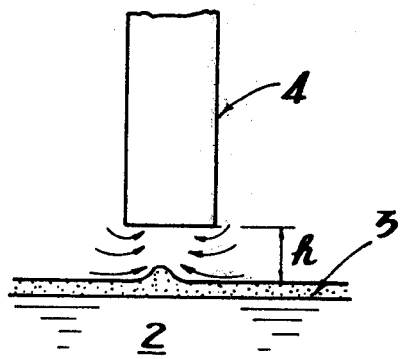
FIG. 2 is a view illustrating the behavior of suction on scum in the vicinity of a conventional suction head.
Figure 3:
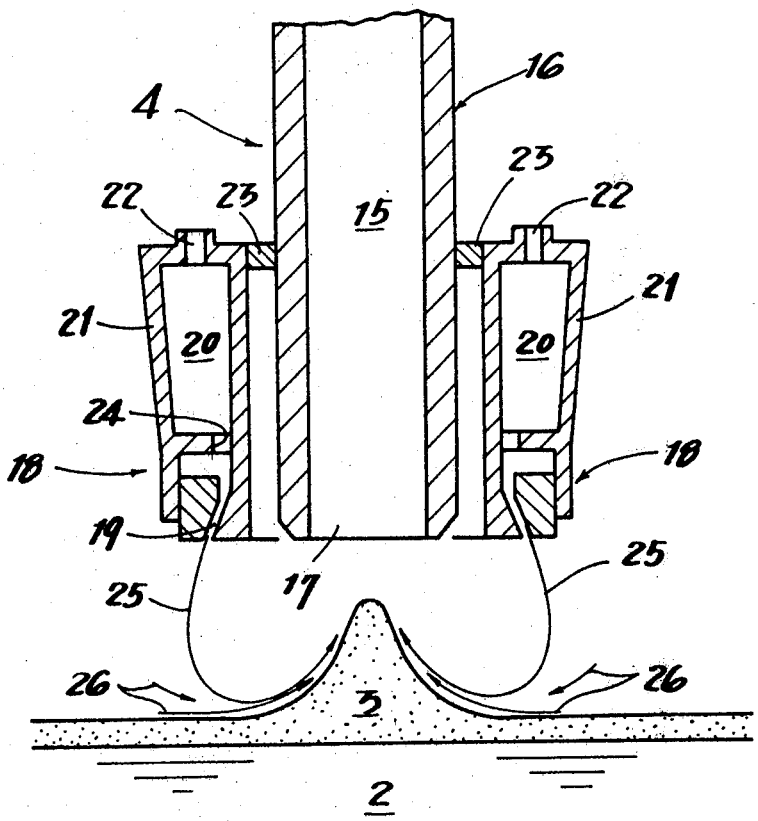
FIG. 3 is a schematic view showing the basic structure of the suction head portion of this invention and the behavior of suction acting on scum.

With reference to FIG. 3, a suction pipe 16 defines the suction channel 15 of a suction head 4. The suction channel 15 has an open end or inlet 17 which is provided by the lower open end of the suction pipe 16 in the illustrated embodiment. The outer end of the suction pipe 16 is in communication with an unillustrated suction source as already described. Annular nozzle means 18 is provided around the suction head 4, namely around the suction pipe 16 in the illustrated embodiment. The nozzle means 18 forms a tubular gaseous stream 25 directed toward the surface of scum 3 on molten metal 2. The annular nozzle means 18 is formed with a nozzle 19 which in the illustrated embodiment is tapered to extend in a downwardly flaring manner such that the gaseous stream forced out therefrom will surround a zone enlarging toward the scum surface in a flaring fashion. A preheating chamber 20 provided around the lower portion of the suction head 4 communicates with the annular nozzle means 18. The gaseous medium in the preheating chamber 20 is heated by the radiant heat from the molten metal 2 and forced out from the annular nozzle 19. The nozzle means 18 has a body 21 integral with a surrounding wall defining the preheating chamber 20 and is formed with inlets 22 opened to the interior of the preheating chamber 20 for supplying the gaseous medium. Indicated at 23 is a mounting for hermetically securing the body 21 to the suction pipe 16.

According to the structure described above, the gaseous medium forced out from the nozzle 19 forms a tubular gaseous stream 25 flowing toward the surface of the scum 3. Since the interior space of the gaseous stream 25 is in communication with the suction source by way of the suction channel 15, the gaseous stream 25, on reaching the surface of the scum 3, is deflected toward the center along the scum surface, further deflected upward at the center portion and drawn into the suction channel 15 through the inlet 17 as indicated by the arrows 25. At this time, the gaseous curtain provided by the gaseous stream separates the external air from the interior gaseous medium, permitting part of the air to be drawn by the gaseous stream 25 and to flow into the interior space of the stream along with the stream or only between the stream and the scum surface as indicated by the arrows 26. The external air flows toward the center along the scum surface and is sucked into the inlet 17 together with the gaseous stream. Thus the gaseous stream 25 and the external air flow 26 along the surface of scum 3 blow the scum toward the center of the inlet 17 of the suction pipe 16 radially inwardly thereof, further acting to raise the scum toward the inlet 17. Accordingly, the higher flow velocity of the stream 25 and therefore the higher the flow velocity of the gaseous stream along the surface of the scum 3, the more effectively will the suction source suck the scum. Of course, the velocity of the outflow of the gaseous medium from the nozzle 19 is limited to such a range that the gaseous stream 25 can be smoothly deflected inward as shown by the arrows in FIG. 3 under the negative pressure produced by the suction source in the interior space of the gaseous stream. For actual operation, the flow velocity is about 50 to 340 m/sec.

Stated more specifically, with the use of suction means of the capacity of −500 mm Hg, 64 $m^3$/min. which is expected to produce negative pressure of about −200 mm Hg in the internal space of the gaseous stream, the most effective sucking operation will result at a flow velocity of about 0.4 to 0.5 Mach. At a velocity of about 1 Mach, the gaseous stream will spatter the scum. However, when the suction means has an increased capacity, namely when the scum sucking apparatus has an increased capacity, the velocity of the flow of the gaseous stream can be greater. In fact, the flow velocity should preferably be high. Thus the preferred flow velocity is in the range of 0.4 to about 1 Mach.

The supply of the gaseous medium to the annular nozzle means 18 will be described below with reference to the case in which the medium is air. By way of air ducts, air is fed to the inlets 22 at pressure of about 5 kg/$cm^2$ as provided by a usual compressor. Through the inlets 22, the air is admitted to the preheating chamber 20, in which it is heated to several hundreds of degrees C. by the radiant heat from the surface of the molten metal 2. The hot air flows through ports 24 into the annular nozzle means 18, from which it is forced out through the nozzle 19 as already described. Incidentally, with an embodiment having the numerical value specified above, an air flow velocity of about 1 Mach is obtainable, although dependent on the size and shape of the nozzle. The heating of the air before feeding to the annular nozzle means expands the air and correspondingly reduces the consumption of the compressed air. Moreover, the contraction of the air on cooling within the suction channel 15 permits the use of a suction source of reduced capacity. Further because hot air is applied to the scum 3, the scum will not solidify on cooling but remains flowable and can be sucked smoothly.

Steam is usable as the gaseous medium, in which case the preheating chamber 20 need not be provided.

The flaring form of the gaseous stream 25 in the illustrated embodiment provides a wide zone thereby defined, preventing the zone from decreasing due to the suction. The angle of inclination is inherently limited as is the case with the flow velocity, whereas a gaseous stream flowing straight is also free of any trouble.

Figure 4:
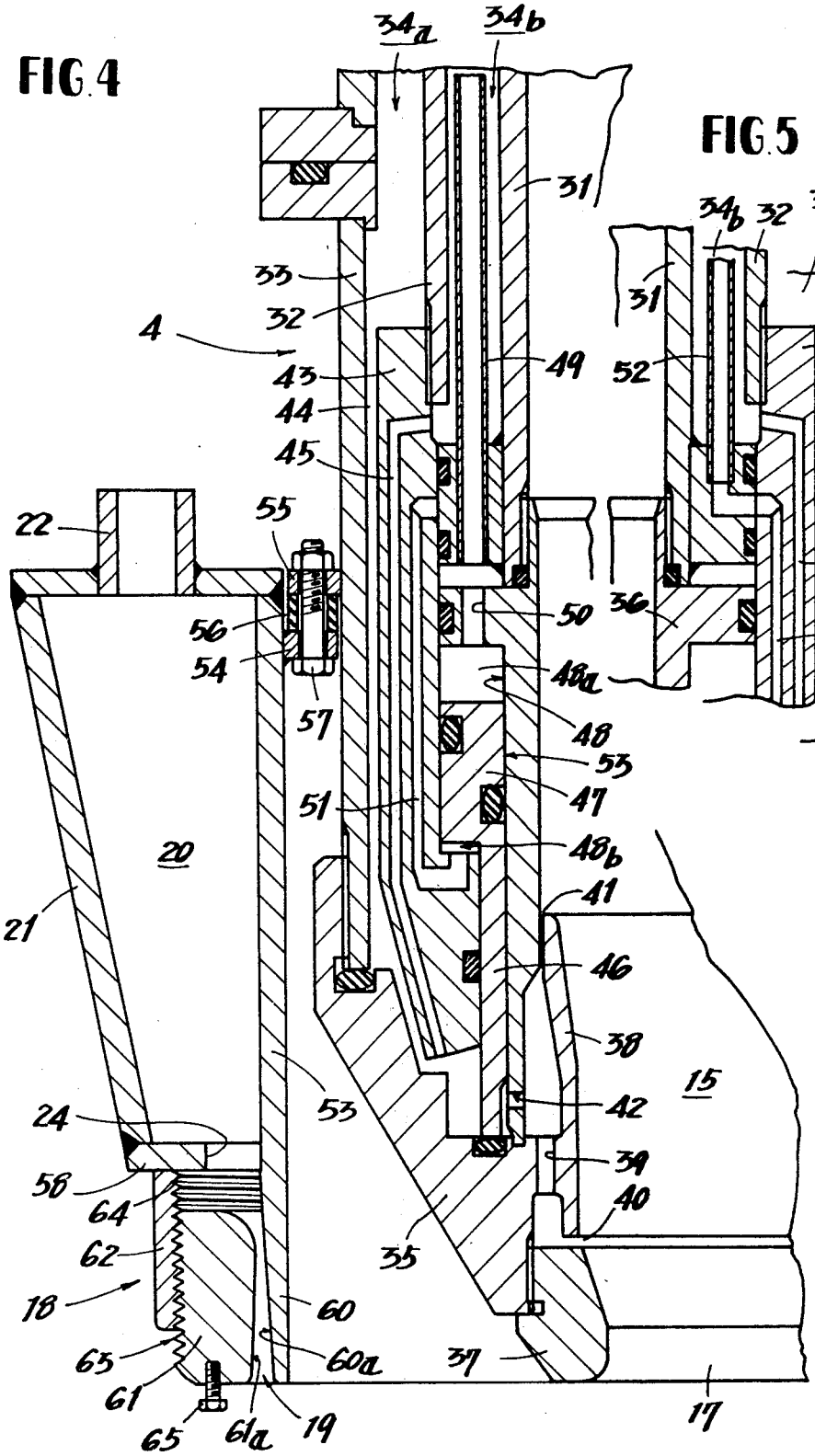
FIG. 4 is a fragmentary enlarged view in vertical section illustrating the preferred embodiment of the suction head portion of this invention to show its specific structure.
Figure 5:
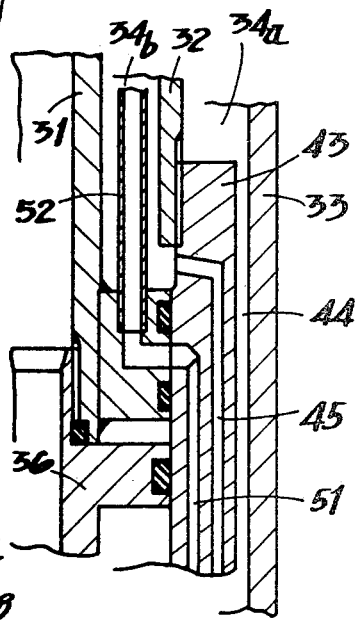
FIG. 5 is a fragmentary enlarged view in vertical section similar to FIG. 4 but taken at a circumferentially different position.

With reference to FIGS. 4 and 5, a more specific preferred embodiment will be described. A suction head 4 includes an inner tube 31 providing a suction channel 15, an intermediate tube 32 and an outer tube 33 which form jackets 34*a* and 34*b* for cooling the suction head 4 with water. An end member 35 is secured to the lower end of the outer tube 33 and also to the lower end of a tubular sleeve 36 extending from the lower end of the inner tube 31. A suction mouthpiece 37 is detachably secured to the inner periphery of the lower end of the end member 35 so as to be replaceable when damaged. An annular partition member 38 integral with the end member 35 is positioned inside the sleeve 36. The lower end face of the partition member 38 and the upper end face of the suction mouthpiece 37 form a first nozzle 40 having an annular opening. The outer peripheral surface of the partition member 38 and the inner peripheral surface of the sleeve 36 provide a second nozzle 41. The junction between the end member 35 and the partition member 38 is formed with ports 39. The sleeve 36 is formed with water ports 42 opposed to the partition member 38 and arranged at equal spacing circumferentially of the sleeve 36. The water ports 42 communicate with the outer water cooling jacket 34*a* via a water supply channel 44 between the outer tube 33 and a shutter supporting member 43 fixedly fitting around the intermediate tube 32. The ports 42 further communicate with the inner water cooling jacket 34b by way of a return channel 45 in the shutter supporting member 43. A shutter 46 prevents the supply of water to the ports 42 when the lower end thereof is in intimate contact with the end member 35. The shutter 46 is supported by the member 43 and the sleeve 36, is vertically slidable therebetween and has an upper piston portion 47 fitting in an annular cylinder chamber 48 defined by the shutter supporting member 43 and the sleeve 36. The cylinder chamber 48 includes an upper chamber 48a communicating with a first oil duct 49 within the inner jacket 34b via an oil port 50 in the sleeve 36, and a lower chamber 48b communicating with a second oil duct 52 within the jacket 34b via an oil port 51 in the shutter supporting member 43 as seen in FIG. 5. The shutter 46 is movable upward or downward by the hydraulic lift means 53 thus provided, by the pressure of oil introduced into the lower chamber 48b or the upper chamber 48a. The initiation and termination of the supply of oil to the oil ducts 49 and 52 is effected by a pressure sensor (not shown) provided in the suction channel 15.

The suction head 4 having the foregoing internal structure is provided therearound with annular nozzle means 18 integral with a preheating chamber 20. The nozzle means 18 has a body 21 including an inner peripheral wall 53 at an upper portion of which is a mounting flange 54. The flange 54 is secured by bolts and nuts 57 to a support flange 55 with a packing member 56 provided therebetween, the support flange 55 being provided around the outer tube 33. In this way, the annular nozzle means 18 is hermetically secured to the outer periphery of the suction head 4. The inner peripheral wall 53 of the body 21 defines the preheating chamber 20 and further extends downward. The extension serves as a member 60 providing the inner peripheral surface of an annular nozzle 19. Thus the outer peripheral surface 60a of the member 60 forms the inner peripheral surface of the nozzle. The nozzle inner peripheral surface is in the form of a conical tapered surface. Indicated at 61 is a member providing the outer peripheral surface of the nozzle 19. The member 61 is held by a tubular retaining member 62 extending downward from a bottom plate 58 forming the preheating chamber and included in the body 21 and is vertically shiftable for adjustment. The tubular member 62 is internally threaded as at 64, while the member 61 is externally threaded as at 63, the threaded portions 64, 63 being adapted for screw-thread engagement with each other. The member 61 is vertically shiftable by being turned. Since the nozzle inner peripheral surface is tapered, the nozzle aperture clearance is variable by vertically shifting the member 61. Further according to the illustrated embodiment, the inner peripheral surface of the member 61, namely the nozzle outer peripheral surface is tapered to flare downward, providing the nozzle 19 with a flaring nozzle aperture to give the gaseous stream a flow velocity in excess of 1 Mach. Indicated at 65 is a handle for turning the member 61. It comprises a bolt screwed into the lower surface of the member 61.

The embodiment will operate in the following manner. The suction head 4 is positioned a suitable distance above the surface of scum 3 in opposed relation thereto. The gaseous medium within the preheating chamber 20 is forced out from the annular nozzle means 18 to form a gaseous stream 25 as shown in FIG. 3. The interior of the suction channel 15 is continuously maintained at negative pressure by unillustrated suction means, whereby the scum can be sucked efficiently into the inlet 17. For the sucking operation, the shutter 46 is in its raised position, leaving the water ports 42 open. Water is fed from the outer jacket 34a through the supply channel 44 to the first nozzle 40, from which the water is forced out toward the axis of the end member 35, whereby the sucked scum 3 is rapidly cooled into fragments. The water applied cools the mouthpiece 37 and wets the inner peripheral surface of the mouthpiece 37, thereby reducing the direct contact of the scum with the mouthpiece 37 and producing a muffling effect. Simultaneously with the application of water from the first nozzle 40, the water is also forced out from the second nozzle 41 along the inner peripheral surface of the sleeve 36. This water prevents the adhesion of the scum to the inner peripheral surface of the sleeve 36. The present embodiment is so designed that 70% of the whole amount of water to be applied is injected through the first nozzle 40, and the remaining 30% through the second nozzle 41. Since the water from the outer jacket 34a is fed at a constant rate due to the resistance at the water ports 42 and also due to the provision of the bypass system including the return channel 45 extending to the inner jacket 34b, the above-mentioned water injection ratio can be accurately maintained at all times. Furthermore such return flow system is effective in preventing local heating.

Should the pressure within the scum suction channel 15 build up to an abnormal level due to a power failure or malfunction of the vacuum pump, the pressure sensor emits a signal, in response to which oil is fed to the upper chamber 48a via the first oil duct 49, lowering the shutter 46 to prevent the water supply to the water ports 42. To initiate the supply of water again, oil is fed to the lower chamber 48b from the second oil duct 52 through the oil port 51, raising the shutter 46. Since the supply of water can be stopped by the shutter 46 positioned very close to the nozzles 40, 41, the application of water from the nozzles 40, 41 can be stopped immediately, ensuring high safety. Moreover, the shutter 40 is reliably operable since it can be forced upward or downward hydraulically within the closed chamber 48.

We claim:

1. A method of removing slag-like scum floating on the surface of a molten material comprising positioning a suction head above the surface of said scum, forming a tubular gaseous stream directed from the suction head toward the surface of said scum, and removing said scum by applying negative pressure through the suction head to the interior space surrounded by the tubular gaseous stream to cause the removal of said scum through said interior space and suction head.

2. A method as defined in claim 1 wherein the gaseous stream is an air stream.

3. A method as defined in claim 1 wherein the gaseous stream is a steam stream.

4. A method as defined in claim 1 wherein the gaseous stream is tapered to provide an interior place enlarging toward the scum surface.

5. A method as defined in claim 1 wherein the gaseous stream is preheated.

6. A method of removing slag-like scum floating on the surface of a molten material comprising forming a tubular gaseous stream directed toward said surface and removing said scum by applying negative pressure to the interior space surrounded by the tubular gaseous stream.

7. A method as defined in claim 6 wherein the gaseous stream is an air stream.

8. A method as defined in claim 6 wherein the gaseous stream is a steam stream.

9. A method as defined in claim 6 wherein the gaseous stream is tapered to provide an interior space enlarging toward the scum surface.

10. A method as defined in claim 6 wherein the gaseous stream is preheated.

* * * * *

UNITED STATES PATENT AND TRADEMARK OFFICE

CERTIFICATE OF CORRECTION

PATENT NO. : 4,160,662

DATED : July 10, 1979

INVENTOR(S) : KATSUMI NAGASAKI, YOSHIHIRO INOUE, HIROYUKI YAMAZAKI, AKIFUMI YANO and TETSUO MOMOSE It is certified that error appears in the above-identified patent and that said Letters Patent are hereby corrected as shown below:

Column 6, line 59, "place" should read -- space --.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*